United States Patent [19]

Rydborn

[11] Patent Number: 4,948,130

[45] Date of Patent: Aug. 14, 1990

[54] GOLF TEE

[76] Inventor: Sten A. O. Rydborn, Klöxhulsvagen 21, 343 00 Almhult, Sweden

[21] Appl. No.: 231,529

[22] Filed: Aug. 12, 1988

[30] Foreign Application Priority Data

Aug. 12, 1987 [SE] Sweden ..... 8703130

[51] Int. Cl.[5] ..... A63B 57/00

[52] U.S. Cl. ..... 273/33; 273/32 B

[58] Field of Search ..... 273/30, 32 B, 203–212, 273/32.5, 33

[56] References Cited

U.S. PATENT DOCUMENTS

| | | | |
|---|---|---|---|
| 1,410,483 | 3/1922 | Lard | 273/209 |
| 1,656,401 | 1/1928 | Totten | 273/33 |
| 1,730,046 | 10/1929 | Stow | 273/33 |
| 1,864,516 | 6/1932 | Becket | 273/33 |
| 2,560,414 | 7/1951 | Cheney | 273/33 |
| 2,589,763 | 3/1952 | Barrett | 273/203 |
| 3,347,551 | 10/1967 | Dreyfus | 273/33 |
| 3,782,723 | 1/1974 | Morris | 273/33 |
| 4,241,917 | 12/1980 | Cohen | 273/33 |

*Primary Examiner*—Theatrice Brown

*Attorney, Agent, or Firm*—Beveridge, DeGrandi & Weilacher

[57] ABSTRACT

The disclosure relates to a device for supporting s spherical object, primarily a golf ball above a substrate, primarily a teeing ground on a golf course, the device having a head with a support surface suited for the spherical object, the head being disposed on one end of a shaft which may be stuck into the substrate, and the device being generally designated a 'peg' or 'tee', the head being provided on its outside with connection members for cooperation with connection members on a further identical device and pairwise interconnection of the devices with one another.

8 Claims, 1 Drawing Sheet

GOLF TEE

The present invention relates to a device for supporting a spherical object, primarily a golf ball, in or slightly above a substrate, primarily a teeing ground on a golf course, the device having a head with a support surface suitable for the spherical object, the head being disposed on one end of a shaft which may be stuck into the substrate, the device being generally designated a 'peg' or 'tee'.

In particular, the game of golf requires that players be equipped with a large number of accessories—which may appear trivial to the uninitiated—but which must be carried during a round. A result, it may, on many occasions, be difficult to keep track of all of these accessories and it is easy to forget an accessory which is vital in many contexts while remembering a less crucial accessory. Naturally, it is particularly easy to forget accessories, which are of themselves vital, if they are called into use on only the odd occasion but are nevertheless indispensible. Hence, a general wish has be voiced to be able to reduce the number of accessories by employing one and the same accessory for several purposes. Tees or pegs are an accessory which every golfer carries in abundance and, therefore, it is a suitable point of departure to employ a peg for devising another accessory.

The task forming the basis of the present invention is to realise a peg which, together with an additional number of pegs, may be combined to form, for example, a putting green repair rake.

This task is solved according to the present invention in the device disclosed by way of introduction, in that the head of the device is provided on its outside with connection members for cooperation with connection members on a further device, and for pairwise interconnection of the devices with one another such that these extend in parallel. The connection members are identical and are located on a planar surface on one side of the head. On the diametrically opposed side in relation to the surface with the connection members, the head is provided with a planar surface, preferably a display surface.

The connection members are in the form of two mutually parallel grooves which form two L-shaped projections fitting in the grooves of a further such device. The grooves and, thereby, the projections, extend in the longitudinal direction of the device. The shaft of the device has a cavity which discharges in the head, through which the cavity extends to the support surface intended for the spherical object, the configuration of the cavity substantially corresponding to at least a part of the tip portion of the shaft in order to permit the insertion of a further device in cavity. The shaft has a tip portion of a diameter which, in a direction towards the head, merges into a shaft portion of slightly larger diameter than the tip portion. The tip portion fits in the cavity in the shaft, while the shaft portion fits in the cavity in the head, whereby pairwise interconnected devices may be inserted into one another for forming an implement, preferably a green repair rake.

Employing the device according to the present invention, it is eminently possible wholly to eliminate one accessory which the golfer need then no longer keep track of and carry during the game, since the accessory in question (which in this case consists of a green repair rake) is devised using a number of identical pegs which are interconnected and assembled to form a green repair rake. Furthermore, the peg according to the present invention is moreover provided with a display surface which may be employed for advertising and informative purposes.

The present invention will now be described in greater detail below with particular reference to the accompanying drawing. In the accompanying drawing, FIG. 1 is a side elevation of one embodiment of a device according to the present invention.

Figure 4:
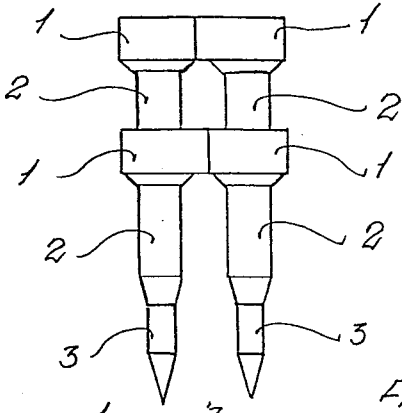
FIG. 4 is a side elevation of a number of devices according to FIG. 1 which are interconnected and combined to form a green repair rake.

the embodifment of a device according to the present invention as shown on the drawing is a so-called peg which is employed for supporting a golf ball from a substrate in order to facilitate driving the ball. Advantageously, the peg is manufactured of a self-destructing material. In the present case, a water-soluble plastic of per se known type is particularly appropriate.

The device according to the present invention has a head 1 on a shaft consisting of an upper portion 2 and a lower portion 3. The head 1 and the upper portion 2 as well as the lower portion 3 are of one-piece manufacture. The lower portion 3 is pointed to facilitate penetration of the peg into a substrate, for example a driving mat on a teeing ground. The upper portion, or intermediate portion 2, on which the head 1 is disposed, is of slightly greater diameter than the lower portion, or tip portion 3. Advantageously, the transition between the tip portion 3 and the interemediate portion 2 is progressive at substantially the same angle as that of the tip on the tip portion 3.

Figure 3:
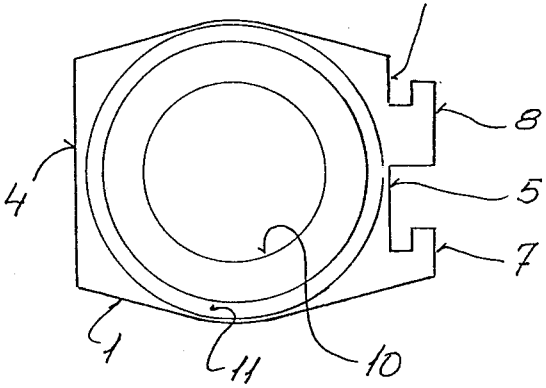
FIG. 3 shows, on a larger scale, a part of the end elevation of FIG. 2.

The head 1 is of slightly larger diamete than the intermediate portion 2 and is, on its one side, flattened to form a planar display surface 4 on which it is appropriate to mould a company name, a logotype, a trademark etc. On that side of the head 1 which is diametrically opposed in relation to the display surface 4, there are disposed two mutually parallel grooves 5 and 6 for forming two generally L-shaped projections 7 and 8, of which at least the projection 8 is of the same configuration as the groove 5 and fits therein, while a portion of the projection 7 fits into the groove 6. The projections 7 and 8 and the grooves 5 and 6 are shown in greater detail in FIG. 3.

In the upper portion, or intermediate portion 2 of the shaft, there is disposed a cavity 9 of the same diameter as the diameter of the lower portion, or tip portion 3 and of substantially the same length as the length of the tip portion 3. A cavity 10 is also disposed in the head 1, the cavity being of the same diameter as the outer diameter of the upper portion, or intermediate portion 2. The two cavities 9 and 10 are, naturally, in communication with one another or discharge into one another. The discharge of the cavity 10 is chamfered or countersunk to form a support surface 11 for the golf ball so that the golf ball will receive improved support and thereby show less of a tendency to roll off from the peg.

Figure 5:
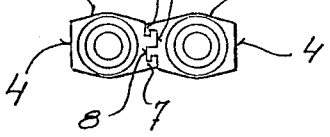
FIG. 5 is an end elevation of the green repair rake exemplified in FIG. 4.

FIG. 5 shows the interconnection of two devices according to the present invention in side-by-side relationship. The cooperation between the grooves 5 and 6 and the projections 7 and 8 is particularly clearly apparent from FIG. 5. FIG. 4 illustrates the interconnection of four devices according to the present invention to form a putting green repair rake. In many cases, only two mutually interconnected devices may be sufficient, but if a more serious repair is required, it may be suitable to interconnect four or six devices according to the present invention.

Figure 6:
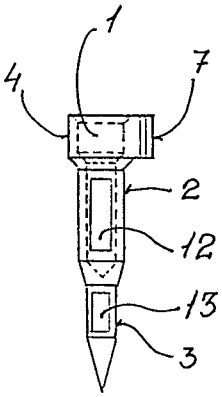
FIG. 6 is a similar side elevation to that of FIG. 1 of a further embodiment of a device according to the present invention.
Figure 1:
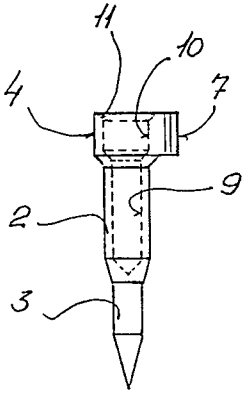
Figure 2:
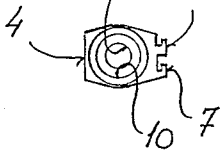
FIG. 2 is an end elevation of the embodiment of FIG. 1.

The embodiment of the device according to the present invention shown in FIG. 6 is substantially identical to the embodiment described above, although a planar or quasi-planar surface 12 is disposed on the intermediate portion 2 and a planar or quasi-planar surface 13 is disposed on the tip portion 3. Such planar surfaces 12 and 13 may, if desired, be disposed on opposing side in register with one another, for improved use of the interconnected devices as a green repair rake. These additional surfaces 12 and 13 may, naturally, also be employed for advertising or other informative purposes.

I claim:

1. A device for supporting a golf ball on a substrate such as the tee area of a golf course, said device having a shaft for penetrating the substrate, a head disposed on one end of the shaft and provided with a support surface for receiving and supporting a ball, said head having a first planar surface thereon, said head having means including external connection members for repeated engaging and disengaging corresponding external connection members on another substantially identical device to interconnect two substantially identical devices in parallel with each other, said external connection members in parallel with each other, said external connection members being located on said first planar surface, each of said connection members having a groove and a projection having a shape that fits into a groove on a substantially identical device.

2. A device according to claim 1 wherein the head has a second planar surface that is primarily a display surface, said second planar surface being diametrically opposed to the first planar surface.

3. A device according to claim 1 in which each of said connections is members has a groove and an L-shaped.

4. A device according to claim 3 in which said groove extends longitudinally of the device.

5. A device according to claim 1 in which a cavity extends from said support surface into said head and shaft, said shaft having a lower tip portion with an external configuration corresponding to part of said cavity in order to permit insertion of said tip portion into said cavity of a substantially identical device.

6. A device according to claim 5 in which the shaft has an upper portion with a larger diameter than the lower tip portion.

7. A device according to claim 6 in which a portion of said cavity in said head has a diameter substantially corresponding to the upper portion of the shaft, and said cavity has a portion in the upper portion of the shaft that has a diameter substantially corresponding to the lower tip portion.

8. A device according to claim 1 in which said groove extends longitudinally of the device.

* * * * *